United States Patent [19]

Andreasson

[11] Patent Number: 4,520,967

[45] Date of Patent: Jun. 4, 1985

[54] DEVICE FOR A ROLL SPINDLE

[75] Inventor: Bengt A. Andreasson, Åmål, Sweden

[73] Assignee: Aktiebolaget Amals Mekaniska Verkstad, Amal, Sweden

[21] Appl. No.: 560,876

[22] Filed: Dec. 13, 1983

[30] Foreign Application Priority Data

Dec. 20, 1982 [SE] Sweden ..... 8207249

[51] Int. Cl.[3] ..... B65H 75/24

[52] U.S. Cl. ..... 242/55; 242/58.6; 242/68.3

[58] Field of Search ..... 242/67.1 R, 57.1, 75.4, 242/58.6, 68.3, 55; 74/105, 110

[56] References Cited

U.S. PATENT DOCUMENTS

| | | | |
|---|---|---|---|
| 2,624,522 | 1/1953 | Van Hook | 242/58.6 |
| 2,664,191 | 12/1953 | May | 74/110 X |
| 3,988,938 | 11/1976 | Nagai | 74/110 X |
| 4,141,517 | 2/1979 | Olcer | 242/68.3 |
| 4,366,932 | 1/1983 | Focke | 242/58.6 |

*Primary Examiner*—Stephen Marcus
*Assistant Examiner*—Leo J. Peters

[57] ABSTRACT

A device for a roll spindle for unwinding or winding up a web material comprises a brake mechanism, a clutch between the spindle and the brake mechanism for axial connection of said parts, and means provided to perform two operations in the axial direction, namely a first operation for causing the mechanism to be moved towards or from the roll spindle in the axial direction for the engagement and disengagement, respectively, of the mechanism with and from the spindle, respectively, and a second operation causing the mechanism when connected with the spindle to be moved in the axial direction for lateral adjustment of the web material. The device is characterized by an articulated joint (15) with a link (16) between a first (17) and a second (18) hinge joint, whereby said first hinge joint is connected to said mechanism (2) and whereby said means for providing said first operation comprise means (24, 20) for displacing said second hinge joint relative to said first hinge joint and means (12, 3) provided at the same time to prevent the mechanism from significantly rotating about its center axis, whereby the mechanism is forced to move in its axial direction, while said means for performing the second operation comprise means (24, 26, 27, 20) for locking said second hinge joint (18) such that said second hinge joint during said operation remains essentially stationary, and means (12, 3) provided at the same time to rotate the mechanism about its center axis such that the articulated joint also in this case will force the mechanism to perform a movement in the axial direction.

5 Claims, 4 Drawing Figures

1
II
II
24
2
4
12
3

DEVICE FOR A ROLL SPINDLE

FIELD OF INVENTION

This invention relates to a device for a roll spindle for unwinding or winding up a web material. More particularly the invention relates to a device comprising a mechanism, for example a brake mechanism or a driving mechanism, a clutch between the spindle and said mechanism for axial connection of said parts, and means provided to perform two operations in the axial direction, namely a first operation for causing the mechanism to be moved towards or from the roll spindle in the axial direction for the engagement and disengagement, respectively, of the mechanism and the spindle, and a second operation causing the mechanism when connected with the spindle to be moved in the axial direction, for instance for lateral adjustment of the web material.

BACKGROUND ART

For the lateral adjustment of the web material by devices of the above referred type there have up to now mostly been used conventional screw mechanisms, which are troublesome to handle. It is also known in the art to use ball screw actuators, which can be provided to perform the axial movement for the lateral adjustment via articulated joints. According to prior art these devices, however, have only been able to be used for said second operation, while said first operation has been performed manually, which has required great hand-power. This heavy work has for long been looked upon as a serious drawback of these devices, which in other respects often can be very efficient.

DISCLOSURE OF THE INVENTION

The first object of the invention is to eliminate the above mentioned problem by offering an integrated apparatus, which will make it possible in a rational way to perform both said operations. This object according to the invention can be satisfied wherein the integrated apparatus comprises an articulated joint with a link between a first and a second hinge joint, whereby the first hinge joint is connected to said mechanism and whereby said means for providing the first operation comprise means for displacing the second hinge joint, and means provided at the same time to prevent the mechanism from significantly rotating about its axis, whereby the mechanism is forced to move in its axial direction, while said means performing the second operation comprise means for locking the second hinge joint such that said second hinge joint during said operation remains essentially stationary, and means provided at the same time to rotate the mechanism about its axis such that the articulated joint also in this case will force the mechanism to perform a movement in the axial direction.

Further characteristic features, aspects and advantages of the invention will be apparent from the following description of a preferred embodiment and from the appending claims.

BRIEF DESCRIPTION OF THE DRAWINGS

In the following description of a preferred embodiment reference will be made to the accompanying drawings, in which.

DESCRIPTION OF A PREFERRED EMBODIMENT

Figure 1:
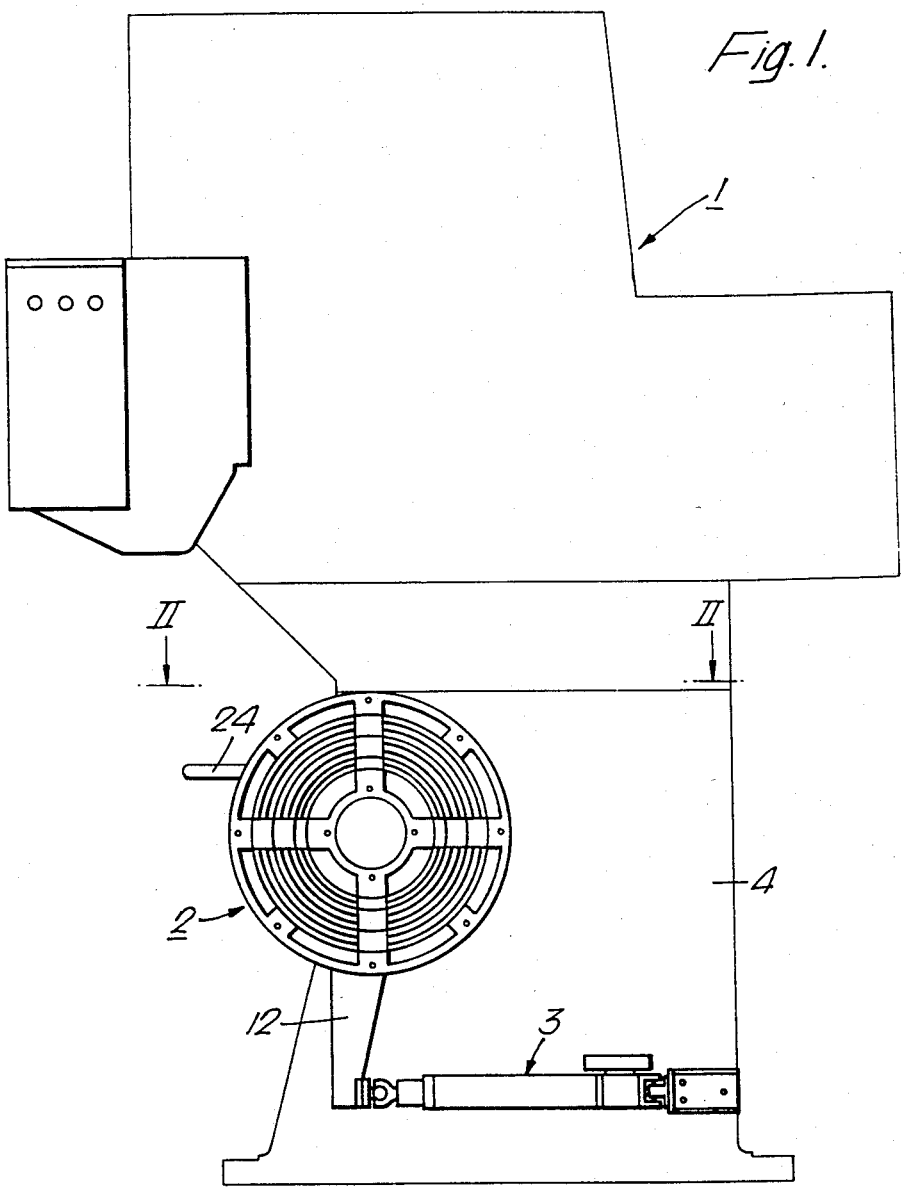
FIG. 1 is a side view of a printing unit, which is provided with the device according to the invention.

The printing unit 1 shown in FIG. 1 contains a roll spindle for the roll of web material which shall be unwound during the printing. The roll spindle is not shown in the drawing. A brake mechanism 2 is connected to one end of the roll spindle via a bayonet clutch. The centre axis of the brake mechanism 2 is coaxial with the centre axis of the roll spindle. FIG. 1 also shows an actuator device 3 of the ball screw type. A machine frame has been designated 4.

Figure 2:
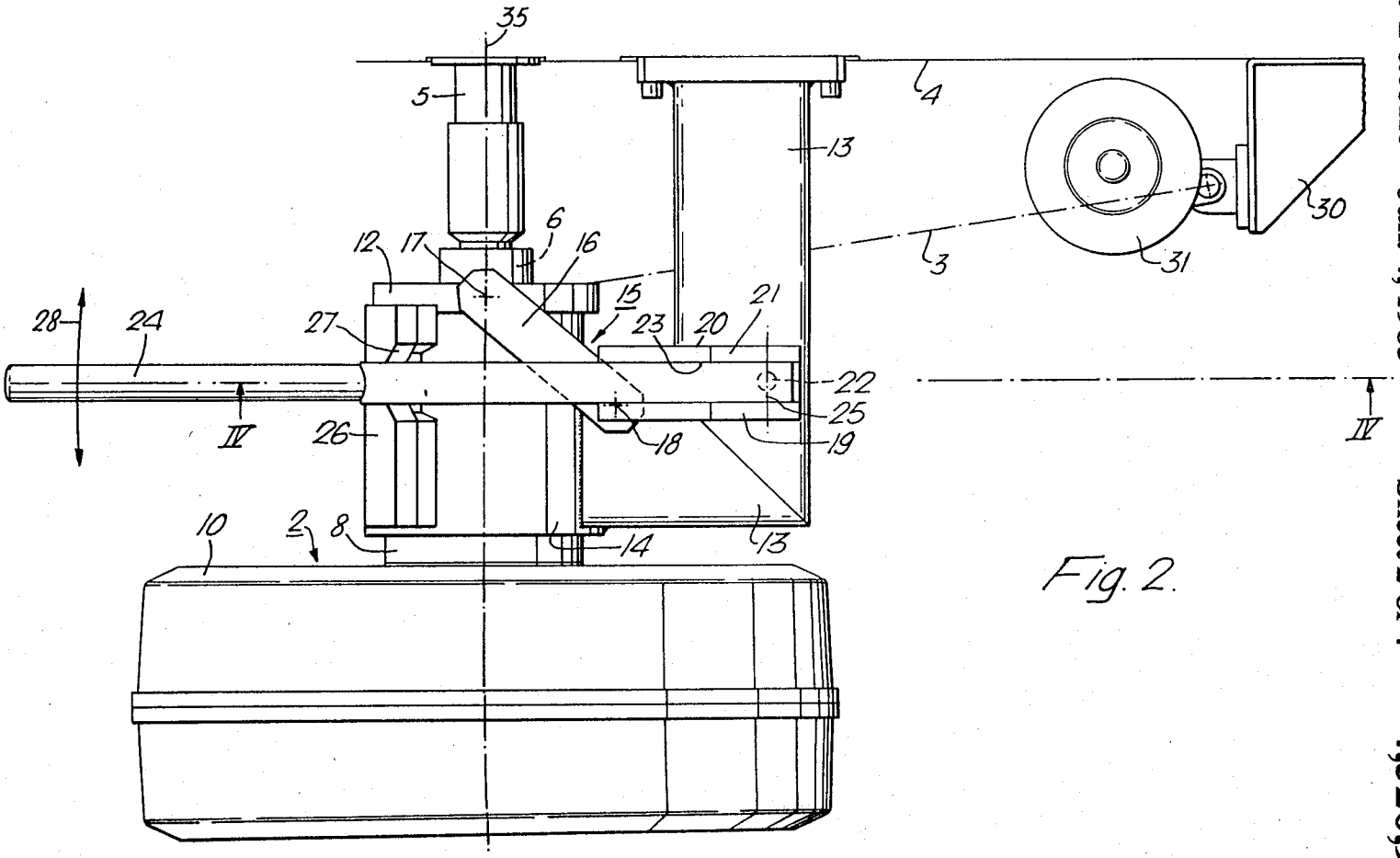
FIG. 2 is a view II—II in FIG. 1.
Figure 3:
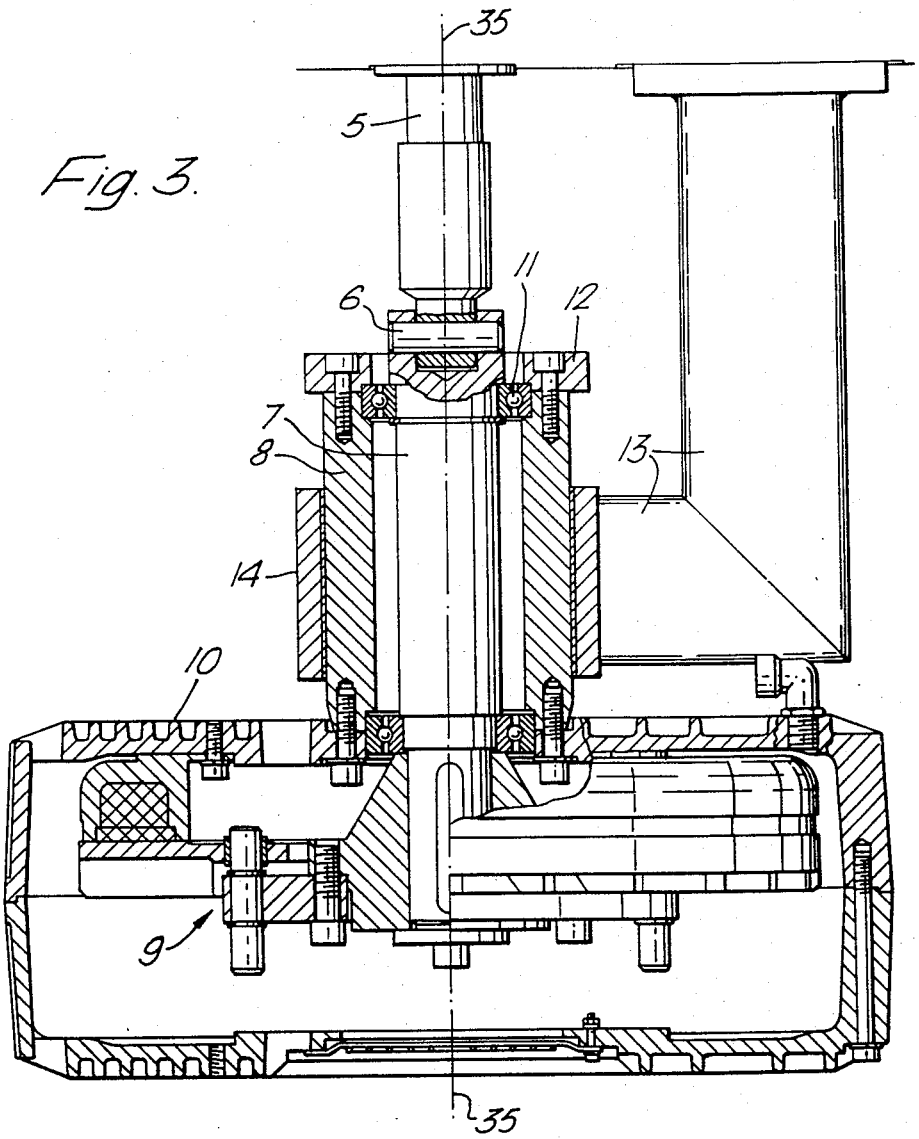
FIG. 3 is an axial section through a brake mechanism as shown in FIG. 2.

In FIG. 2 and FIG. 3 one end of the roll spindle is shown, which is designated 5. The roll spindle 5 is connected to a shaft 7 via a bayonet clutch 6, the shaft 7 being connected with a brake unit 9 in the brake housing 10 via a sleeve 8. The brake 9 is a conventional electromechanically operated brake and it will not be more closely explained here. The shaft 7 is mounted in a roller bearing 11, which is clamped up between the sleeve 8 and the upper portion of an actuator operated lever 12.

The brake mechanism 2 is supported by an angular bracket 13. One leg of the bracket 13 is mounted on the machine frame 4 and the other end of the bracket 13 is welded to a collar 14 around the sleeve 8.

Figure 4:
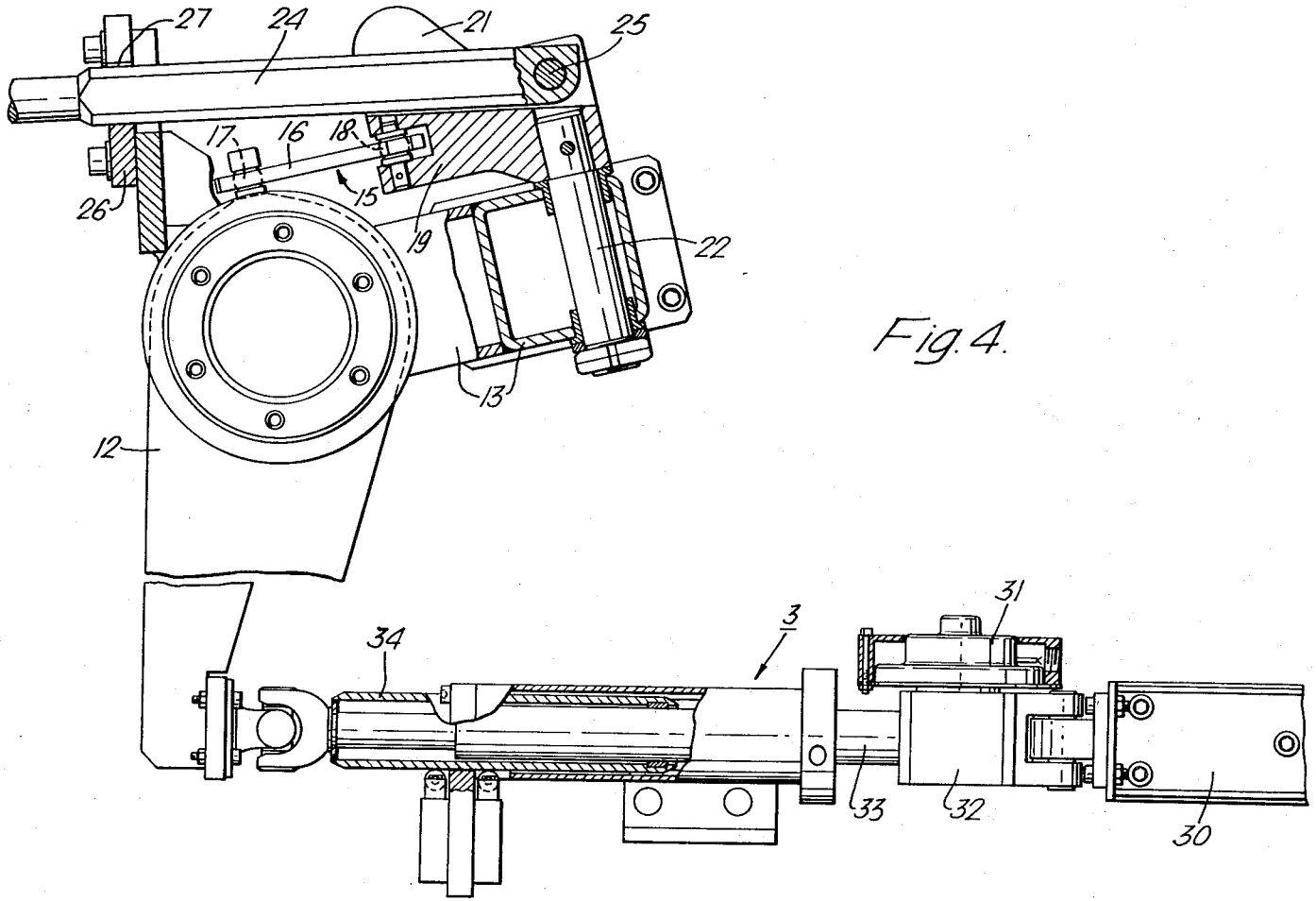
FIG. 4 is a view IV—IV in FIG. 2.

An articulated joint is generally designated 15 in FIG. 2. The joint consists of a link 16 made from a flat bar with a first hinge joint 17 connected to the actuator operated lever 12 and therewith also to the brake mechanism via the sleeve 8, and with a second hinge joint designated 18. This second hinge joint 18 is connected to one branch 19 of a fork-shaped support 20 for a hand operated lever 24. The second branch of the lever support 20 is designated 21. The design of these members is more closely shown in FIG. 4. In this figure the branch 19 is partially sectioned. The branches 19 and 21 in their left hand parts are provided with projecting ears. The lever support 20 can be rotated about an axle spindle 22 mounted in the bracket 13.

The space between the branches 19 and 21 in the lever support 20 defines a guiding groove 23 for the rear part of the hand operated lever 24, which in its rear part is mounted in the lever support 20 by a hinge joint 25 extending between the two branches 19 and 21. Approximately in the centre part of the hand operated lever 24 there is a second lever support 26 with a locking groove 27. The second lever support 26 is mounted on the collar 14. The hand operated lever 24 can be lifted from the locking groove 27 and be turned forwards or backwards as is indicated by arrows 28 when the lever 24 has left the groove 27. Therefore, by means of the hand operated lever 24 the fork-shaped first lever support 20 can be rotated about its axle spindle 22. On the other hand, when the hand operated lever 24 is engaged in the locking groove 27, the fork-shaped first lever support 20 is locked in the position as shown in FIG. 2.

The lower end of the actuator operated lever 12 is connected to the actuator device 3, the rear end of which is connected to a bracket 30 on the machine frame 4. The actuator device 3, which in FIG. 2 is indicated only by a dash-and-dot line, is of a conventional type and comprises an actuator motor 31 with a worm gear 32. The output ball screw 33 of the worm gear 32 is provided during operation to cause an actuator rod 34 to make an axial movement which is transferred to the lever 12 for rotating the sleeve 8 and therewith also rotating the brake mechanism 2 about its centre axis 35, which is the centre axis of the spindle 5.

The apparatus described above may be used in the following manner for the performance of the two operations mentioned in the preamble. The first operation is performed by means of the hand operated lever 24 for connecting or disconnecting the brake mechanism 2 with or from the spindle 5, provided the bayonet clutch 6 is in position for connection or disconnection, respectively. The hand operated lever 24 is lifted so that it is disengaged from the locking groove 27, whereafter the operator may pull the lever 24 in the direction towards or from the brake mechanism 2; arrows 28 in FIG. 2. Then the first lever support 20 will be rotated about the axle shaft 22. If for example the operator will pull the lever 24 in a direction towards the brake mechanism in order to disengage the mechanism from the spindle 5, the first lever support 20 and hence the second hinge joint 18 of the articulated joint 15 will be turned downwards with reference to FIG. 2. This will cause the link 16 to pull the sleeve 8 and hence the brake mechanism 2 outwards via the first hinge joint 17, i.e. in a downward direction with reference to FIG. 2. This result is achieved therein that the actuator device 3 essentially prevents the actuator operated lever 12 from rotating about the centre axis 35. Only a negligible change of angle of the lever 12 will take place because of the axial displacement which also will turn the actuator device 3 slightly sidewards. When the mechanism 2 thus has been disconnected from this spindle 5, it is possible to remove the spindle in the perpendicular direction, for example for loading a new web material roll in the printing unit 1. When the brake mechanism 2 shall be connected again with the new spindle 5, this is performed in an analogous mode of operation by pulling the hand operated lever 24 in the opposite direction, i.e. inwards towards the printing unit 1, i.e. upwards with reference to FIG. 2.

If the web material roll in the printing unit 1 needs to be adjusted in the lateral direction, e.g. for adjusting the print, the hand operated lever 24 is lowered in the locking groove 27 in the second lever support 26. The lever 24 and the first lever support 20 then are locked in a defined position. The lateral displacement of the spindle 5 with the hand operated lever 24 in the locked position can be performed by remote control by means of the actuator device 3, which will rotate the actuator operated lever 12 about the centre axis 35. This means that the first hinge joint 17 will be turned together with the actuator operated lever 12 in one direction or the other. As the second hinge joint 18 in this moment is fixed in a defined position, the link 16 will force the actuator operated lever 12 to be displaced in an axial direction towards or from the printing unit 1. The axial displacement of the lever 12 will be transferred via the sleeve 8, the brake mechanism 2 and the clutch 6 to the spindle 5 bringing about the desired axial adjustment.

The preceding relates to a preferred exemplary embodiment of the invention, it being understood that variants thereof are possible within the spirit and scope of the invention. For example the principles of the invention may be applied also for other mechanisms than brake mechanisms, as for instance a driving motor.

I claim:

1. Device for a roll spindle for unwinding or winding up a web material, said device comprising:

a mechanism having a central axis and being operatively connected to a roll spindle for developing a torque upon said roll spindle, said roll spindle having a longitudinal axis defining an axial direction;

a clutch between said roll spindle and said mechanism for operatively connecting said roll spindle and said mechanism;

an articulated joint including a link extending between a first and a second hinge joint, said first hinge joint being connected to said mechanism;

means for performing first and second operations in said axial direction, said first operation causing said mechanism to move towards or away from said roll spindle in said axial direction for engagement and disengagement, respectively, of said mechanism and said roll spindle, said second operation causing said mechanism when connected with said roll spindle to move in said axial direction, said means for performing said first operation comprising:

means for displacing said second hinge joint relative to said first hinge joint, means for preventing said mechanism from significantly rotating about said central axis when said second hinge joint is displaced relative to said first hinge joint, whereby said mechanism is caused to move in its axial direction, said means for performing said second operation comprising:

locking means for locking said second hinge joint such that said second hinge joint remains essentially stationary during said second operation, and means for rotating said mechanism about said central axis when said second hinge joint is locked by said locking means, such that said articulated joint forces said mechanism to move in said axial direction.

2. Device according to claim 1, wherein said means for performing said first operation comprises a hand operated lever for rotating a support for said second hinge joint.

3. Device according to claim 1, wherein said means for preventing said mechanism from significantly rotating about said central axis during said first operation includes an actuator operated lever.

4. Device according to claim 1, wherein said means for performing said second operation includes a support for a hand operated lever and for said second hinge joint, said support being lockable in a defined position, such that said second hinge joint in said defined position remains stationary, and wherein said means for rotating said mechanism about said central axis is a force generating means connected to an actuator operated lever.

5. Device for a roll spindle for unwinding or winding up a web material, said device comprising:

a mechanism having a central axis and being operatively connected to a roll spindle for developing a torque upon said roll spindle, said roll spindle having a longitudinal axis defining an axial direction;

a clutch between said roll spindle and said mechanism for operatively connecting said roll spindle and said mechanism;

an articulated joint including a link extending between a first and a second hinge joint, said first hinge joint being connected to said first mechanism;

means for performing first and second operations in said axial direction, said first operation causing said mechanism to move towards or away from said roll spindle in said axial direction for engagement and disengagement, respectively, of said mechanism and said roll spindle, said second operation causing said mechanism when connected with said roll spindle to move in said axial direction, said means for performing said first operation comprising:

means for displacing said second hinge joint relative to said first hinge joint, and means for preventing said mechanism from significantly rotating about said central axis when said second hinge joint is displaced relative to said first hinge joint, whereby said mechanism is caused to move in its axial direction, said means for performing said second operation comprising:

locking means for locking said second hinge joint such that said second hinge joint remains essentially stationary during said second operation, and means for rotating said mechanism about said central axis when said second hinge joint is locked by said locking means, such that said articulated joint forces said mechanism to move in said axial direction, said means for performing said second operation including a support for a hand operated lever and for said second hinge joint, said support being lockable in a defined position such that said second hinge joint in said defined position remains stationary, said means for rotating said mechanism about said central axis being a force generating means connected to an actuator operated lever.

* * * * *